US010124198B2

(12) United States Patent
Haggerty

(10) Patent No.: US 10,124,198 B2
(45) Date of Patent: Nov. 13, 2018

(54) SYSTEM FOR RELOCATING THE ELASTIC FORCE ON A TRAMPOLINE

(71) Applicant: Kristofer Haggerty, North Haven, CT (US)

(72) Inventor: Kristofer Haggerty, North Haven, CT (US)

( * ) Notice: Subject to any disclaimer, the term of this patent is extended or adjusted under 35 U.S.C. 154(b) by 0 days.

(21) Appl. No.: 14/517,865

(22) Filed: Oct. 19, 2014

(65) Prior Publication Data

US 2016/0107016 A1 Apr. 21, 2016

(51) Int. Cl.

| | |
|---|---|
| ***A63B 5/11*** | (2006.01) |
| ***A63B 71/00*** | (2006.01) |
| ***A63B 21/02*** | (2006.01) |
| ***A63B 21/04*** | (2006.01) |
| *A63B 21/00* | (2006.01) |

(52) U.S. Cl.

CPC ..... *A63B 5/11* (2013.01); *A63B 21/023* (2013.01); *A63B 21/0435* (2013.01); *A63B 71/0054* (2013.01); *A63B 21/00069* (2013.01); *A63B 2071/0063* (2013.01)

(58) Field of Classification Search

CPC ..... A63B 5/11; A63B 2210/50; A63B 21/023; A63B 2071/0063; A63B 71/0054; A63B 2071/009; A63B 21/026; A63B 21/0552; A63B 71/023; A63B 21/00065; A63B 21/00069; A63B 21/02; A63B 21/0555; A63B 21/15; A63B 21/151; A63B 21/155

USPC ..... 482/23, 27–32

See application file for complete search history.

(56) References Cited

U.S. PATENT DOCUMENTS

| | | | | | |
|---|---|---|---|---|---|
| 2,991,841 | A * | 7/1961 | Sampson | A63B 5/11 | 482/27 |
| 2,999,558 | A * | 9/1961 | Bohrer, Sr. | A63B 5/11 | 24/378.1 |
| 3,276,544 | A * | 10/1966 | Hall | A63B 5/11 | 482/28 |
| 3,891,208 | A * | 6/1975 | Sidlinger | A63B 5/11 | 482/27 |
| 3,983,585 | A * | 10/1976 | Sidlinger | A63B 5/11 | 182/139 |
| 4,162,063 | A * | 7/1979 | Nissen | A63B 5/11 | 182/139 |
| 4,707,934 | A * | 11/1987 | Hart | A63B 25/10 | 36/132 |
| 5,076,479 | A * | 12/1991 | Davison | B60R 9/048 | 211/49.1 |
| 5,385,518 | A * | 1/1995 | Turner | A63B 5/11 | 482/23 |
| 5,433,434 | A * | 7/1995 | Helmetsie | A63B 63/00 | 473/446 |
| 5,630,371 | A * | 5/1997 | Morrelli | B63B 7/06 | 114/61.23 |
| 5,967,718 | A * | 10/1999 | Hoh | B60P 7/135 | 410/100 |
| 6,053,845 | A * | 4/2000 | Publicover | A63B 5/11 | 482/27 |
| 6,129,649 | A * | 10/2000 | Yang | A63B 5/11 | 482/27 |

(Continued)

*Primary Examiner* — Andrew S Lo

(74) *Attorney, Agent, or Firm* — Kristofer L. Haggerty

(57) ABSTRACT

This invention improves on existing trampolines by utilizing a strap and pulley to relocate the resilient means from a horizontal position adjacent to the jumping surface to a vertical position below the upper trampoline frame.

15 Claims, 7 Drawing Sheets

(56) References Cited

U.S. PATENT DOCUMENTS 6,176,050 B1* 1/2001 Gower ..... E04H 9/14 135/115
6,193,632 B1* 2/2001 Steger ..... A63B 5/11 482/27
6,733,420 B1* 5/2004 Schroeder ..... A63B 5/11 482/27
8,226,150 B1* 7/2012 Schmeichel ..... B60P 7/04 296/100.15
8,657,696 B1* 2/2014 Gurley ..... A63B 5/11 472/92
2002/0137598 A1* 9/2002 Publicover ..... A63B 5/11 482/27
2006/0247101 A1* 11/2006 Hall ..... A63B 5/11 482/27
2006/0258509 A1* 11/2006 Adams ..... A63B 5/11 482/27
2006/0258510 A1* 11/2006 McGee ..... A63B 5/11 482/27
2007/0015631 A1* 1/2007 Mo ..... A63B 5/11 482/27
2007/0142180 A1* 6/2007 Publicover ..... A63B 5/11 482/27
2008/0090704 A1* 4/2008 Denis ..... A63B 5/11 482/28
2008/0171638 A1* 7/2008 Chen ..... A63B 5/11 482/27
2008/0269021 A1* 10/2008 Publicover ..... A63B 5/11 482/29
2009/0258760 A1* 10/2009 Plante ..... A63B 5/11 482/29
2009/0270231 A1* 10/2009 Hall ..... A63B 21/0552 482/79
2010/0009812 A1* 1/2010 Pieper Genannt Schmauck ..... A63B 5/11 482/27
2011/0021321 A1* 1/2011 Legg ..... A63B 5/11 482/29
2011/0021322 A1* 1/2011 Schaffer ..... A63B 5/11 482/29
2011/0287899 A1* 11/2011 West ..... A63B 5/11 482/27
2012/0142500 A1* 6/2012 Ronan ..... A63B 5/11 482/29
2013/0303312 A1* 11/2013 DeBolt ..... A63B 69/00 473/446
2014/0051550 A1* 2/2014 Chen ..... A63B 5/11 482/27
2015/0080186 A1* 3/2015 Carlin ..... A63B 5/11 482/27

* cited by examiner

SYSTEM FOR RELOCATING THE ELASTIC FORCE ON A TRAMPOLINE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Pulleys have been around for nearly as long as pulling itself. The disclosed subject matter generally relates to the manner in which elastic force is applied to trampoline beds and the way in which they connect to a trampoline frame. Traditionally, trampoline beds are attached to trampoline frames by utilizing horizontally configured resilient means such as springs or elastics that run between the trampoline bed and the upper trampoline frame. Utilizing this setup aligns the resilient means adjacent and parallel to the jumping surface, exposing users to the risk of landing on the resilient means. The traditional setup presents problems in both safety and operation. Most importantly, landing on the resilient means is likely to cause injury to a user. Additionally, the traditional trampoline setup reduces trampoline bed area and increases the area unsuitable for landing, ultimately reducing the effectiveness of the trampoline.

While the traditional setup is not as problematic for single trampoline setups such as circular shaped backyard trampolines, excessive resilient means surrounding a trampoline bed becomes increasingly problematic when arranging trampolines adjacent to one another to form a trampoline park. In a trampoline park, multiple square or rectangular shaped trampoline beds are arranged closely in a grid allowing users to jump from one bed to another. Traditional trampolines present the problem of exposing users to the risk of landing on the resilient means as well as reducing the trampoline bed area. While traditional trampolines apply padding to the resilient means to reduce the chance of injury, injuries are still common and the problem of minimized trampoline area remains. Generally speaking, minimizing the distance between trampoline beds is advantageous in a trampoline park because it increases both the square footage of trampoline bed per trampoline park and its level of safety.

A trampoline park refers to a grid or array of trampoline beds placed adjacent to one another in a manner suitable for users to jump from one to another. Its intended use is for exercising, both leisure and competitive sport.

Trampoline beds relate to the taut piece of inelastic fabric used as a jumping surface, usually made of canvas or polypropylene.

Resilient means refer to the components that provide elasticity such as springs, elastics, metals, plastics, or other materials with desirable elastic properties.

Padding refers to the cushioning mounted on top of the resilient means and upper trampoline frame, often made of foam or another soft material capable of absorbing the force of an impact.

BRIEF SUMMARY OF THE INVENTION

This invention aims to greatly reduce the problems of both user injury and reduced trampoline bed area for single trampolines and trampoline parks alike. It is achieved by relocating the resilient means from a horizontal position between the upper trampoline frame and trampoline bed to a vertical position below the upper trampoline frame. This is achieved by mounting a pulley on the upper trampoline frame to redirect the force applied to the trampoline beds from a horizontal to a vertical orientation. This allows the resilient means to be relocated to the vacant area directly beneath the upper trampoline frame. Of the many advantages this invention achieves, relocation of the resilient means most importantly frees up a large amount of space between the upper trampoline frame and trampoline bed, allowing the trampoline bed to be enlarged and extended right up to the pulley mounted on the upper trampoline frame. The result is increased trampoline bed area, thereby increasing both safety and trampoline effectiveness. Another advantage of this invention is increased flexibility in choice of resilient means. While the choice of resilient means in a traditional trampoline setup is limited by the distance between the trampoline bed and upper trampoline frame, this invention relocates the resilient means to a larger area that offers more choice in type, size, elasticity, material, and price of the resilient means. Similarly, relocating to this larger area provides the additional space to install tensioning mechanisms, toggle clamps, buckles, and any other features an owner may utilize to make trampoline bed or part replacement quicker, safer, and easier. Utilizing one of these said mechanisms will not only save time and effort, but will also reduce trampoline down time during part replacement.

DETAILED DESCRIPTION OF THE INVENTION

Figure 1:
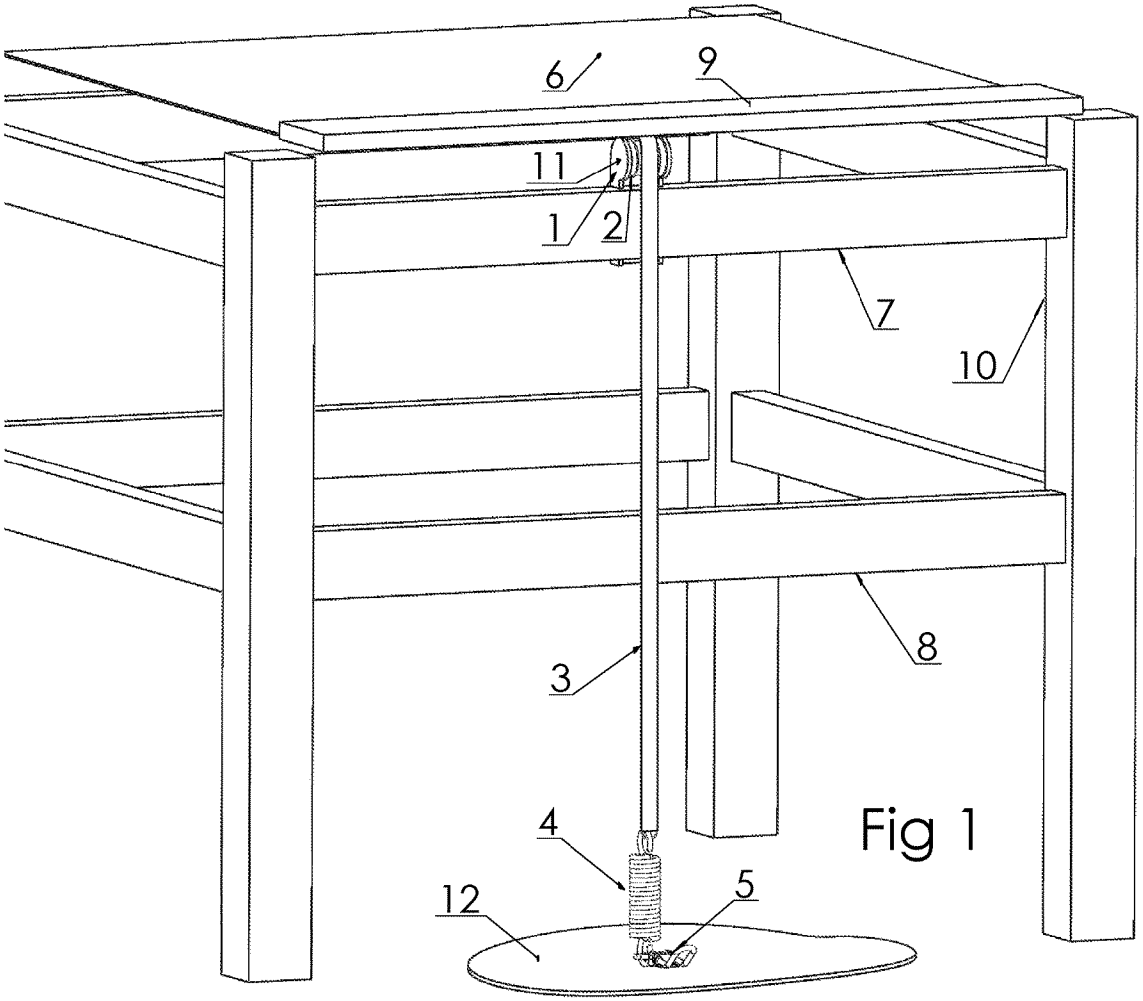
FIG. 1 illustrates an example of the invention in a single trampoline bed setup. Only one assembly of the invention is illustrated to exemplify the device in more clarity. In fully functional operation an array of these assemblies will be utilized to distribute the force applied to the trampoline bed evenly.

FIG. 1 illustrates an assembly of the invention in a single trampoline bed setup. Pulley housing 1 is fixed the to upper trampoline frame 7 via nuts and bolts, welds, the tension of nylon strap 3, gravity, or some other fastening means. Pulley housing 1 is designed and attached in such a way that pulley 2 is centered laterally over the upper trampoline frame 7 when mounted on either side. This is advantageous because a single upper trampoline frame 7 can support adjacent trampoline beds on both sides when applicable, shown in FIG. 5 and FIG. 6. Padding 9 utilizes a rigid bottom half which rests on pulley housing 1 and is displaced from strap 3 and pulley 2 such that the padding never comes in contact with either. The top of padding 9 is made of a soft material such as foam designed to absorb user contact. Pulley 2 is capable of freely spinning on pulley pin 11 within pulley housing 1. Pulley pin 11 is set within pulley housing 1 by a through hole and clevis pin assembly, a milled recess within pulley housing 1, or any other means capable of holding it in place. Nylon strap 3 is connected to both trampoline bed 6 and resilient means 4. Nylon strap 3 is laid halfway around pulley 2 such that pulley 2 redirects the force on nylon strap 3 ninety degrees from a horizontal to a vertical orientation. This allows resilient means 4 to be relocated directly below upper trampoline frame 7 and then attached to optional mechanisms such as tensioner 5. Optional tensioner 5, shown in this drawing, may be replaced by or used in combination with mechanisms such as buckles, clamps, quick connect devices, or any other means to make part replacement easier. Tensioner 5 is then attached to a rigid member such as a lower trampoline frame 8, an anchor in the ground, or another secure attachment point. As force is applied to the trampoline bed 6, nylon strap 3 is displaced over the freely spinning pulley 2 and resilient means 4 is extended. As resilient means 4 contracts, nylon strap 3 is displaced back over freely spinning pulley 2 and trampoline bed 6 returns to its original position, providing bounce to a user.

Figure 2:
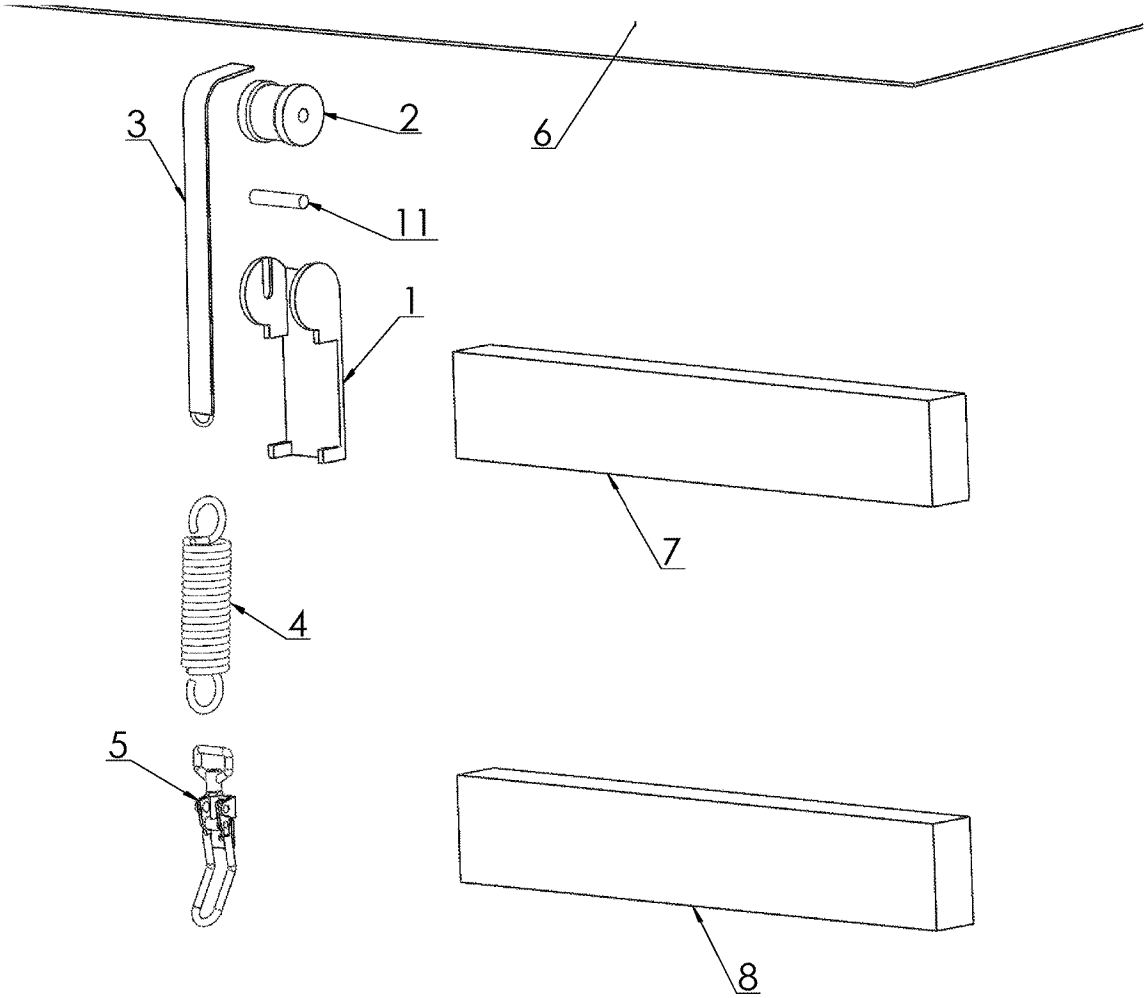
FIG. 2 illustrates an exploded view of the invention shown in FIG. 1.

FIG. 2 illustrates an exploded view of the invention. Strap 3 connects trampoline bed 6 to resilient means 4. Strap 3 is laid halfway around pulley 2 which spins freely on pulley pin 11 within pulley housing 1. Pulley housing 1 is attached to upper trampoline frame 7. Resilient means 4 is then connected to tensioner 5, which is then connected to lower trampoline frame 8 or another secure attachment point such as an anchor in the floor.

Figure 3:
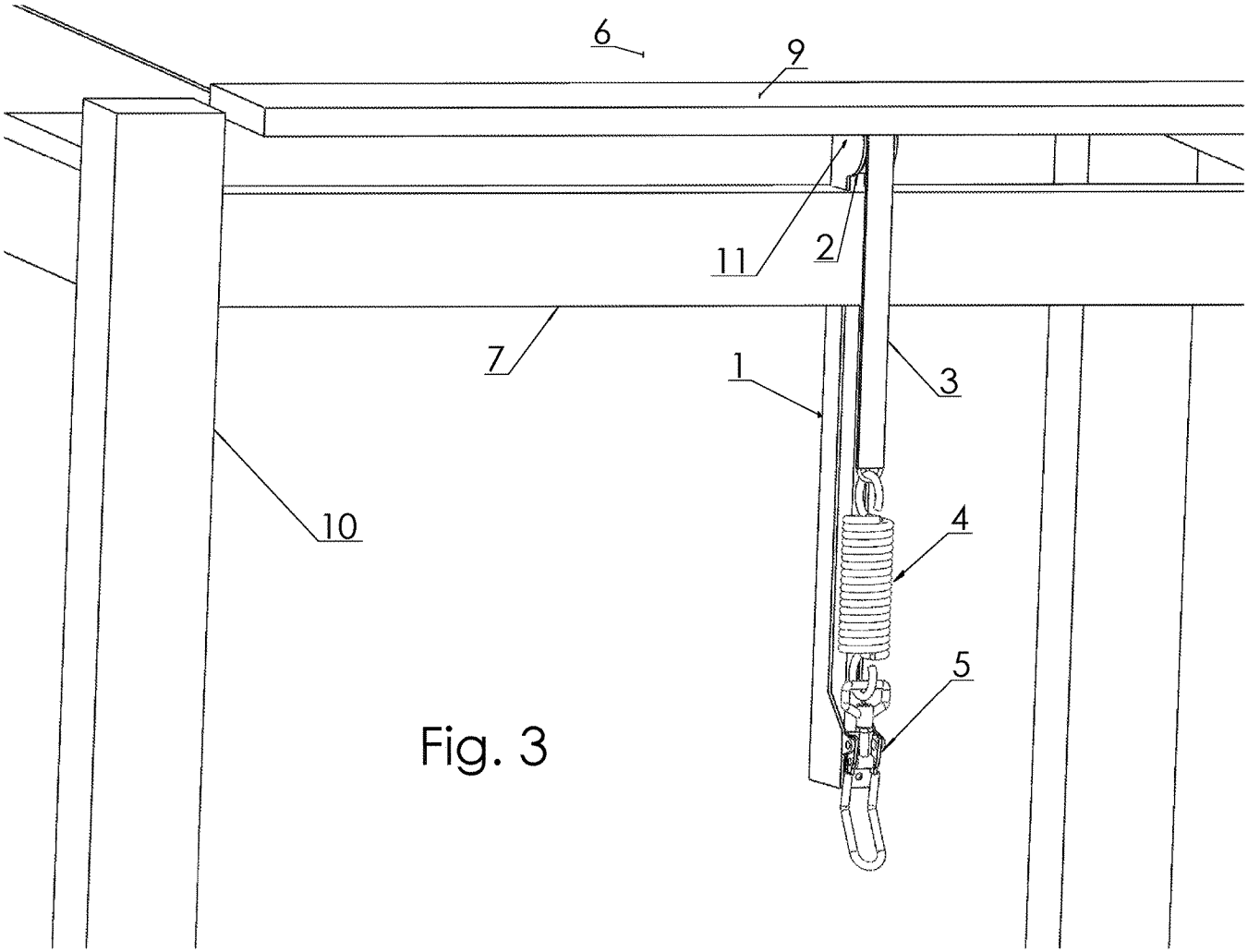
FIG. 3 illustrates an alternative attachment method of the invention in a single trampoline bed setup. This setup can be utilized when lower support members are not utilized, it is not desirable to attach to the floor, or it is more cost effective to extend the pulley housing than establish a secure attachment point. A single assembly of the invention is illustrated here for simplicity, but a full array of the invention is utilized in operation.

FIG. 3 illustrates an alternative attachment method of the invention. It operates in the same manner as the invention in FIG. 1 except pulley housing 1 is designed and fabricated to extend the full length of the invention. Strap 3 is still connected to both trampoline bed 6 and resilient means 4. Strap 3 is laid halfway around pulley 2 which spins freely within pulley housing 1 on pulley pin 11. Pulley housing 1 is fastened to upper trampoline frame 7 which is then supported by vertical column 10. Padding 9 rests on pulley housing 1 and is held in place by means such as nuts and bolts, Velcro straps, rope, or other means to keep it in place. Resilient means 4 is attached to optional component tensioner 5. The biggest difference in this setup method is that rather than connecting to a secure attachment point such as a lower trampoline frame or floor anchor, tensioner 5 is attached to pulley housing 1.

Figure 4:
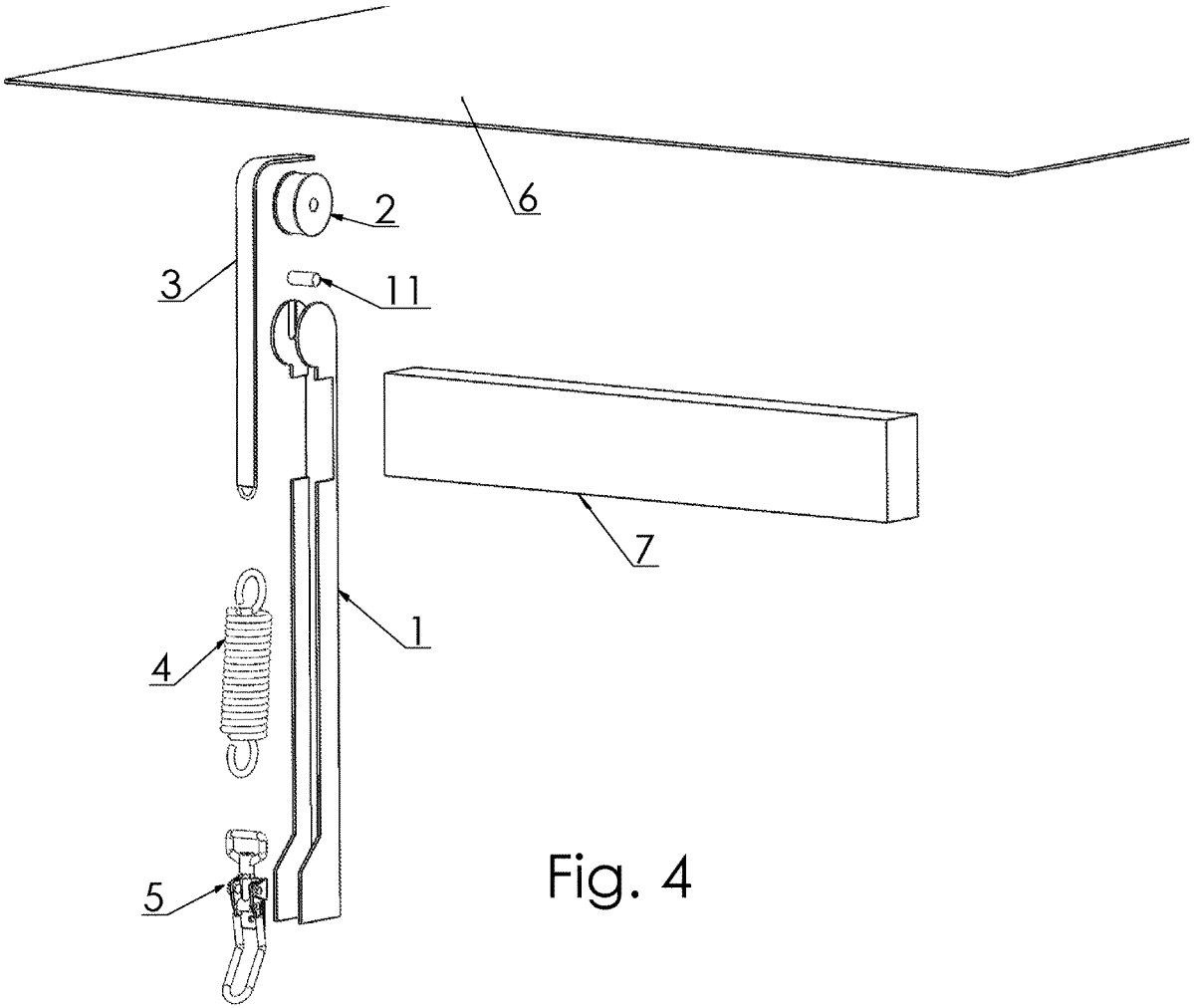
FIG. 4 illustrates an exploded view of the alternative attachment system shown in FIG. 3.

FIG. 4 illustrates an exploded view of the alternative attachment method described and illustrated in FIG. 3. FIG. 4 is operationally identical. Strap 3 connects trampoline bed 6 and resilient means 4 while wrapped halfway around pulley 2. Pulley 2 spins within pulley housing 1 on pulley pin 11. Pulley housing 1 is fixed to both upper trampoline frame 7 as well as optional component tensioner 5. Tensioner 5 is then secured to resilient means 4.

Figure 5:
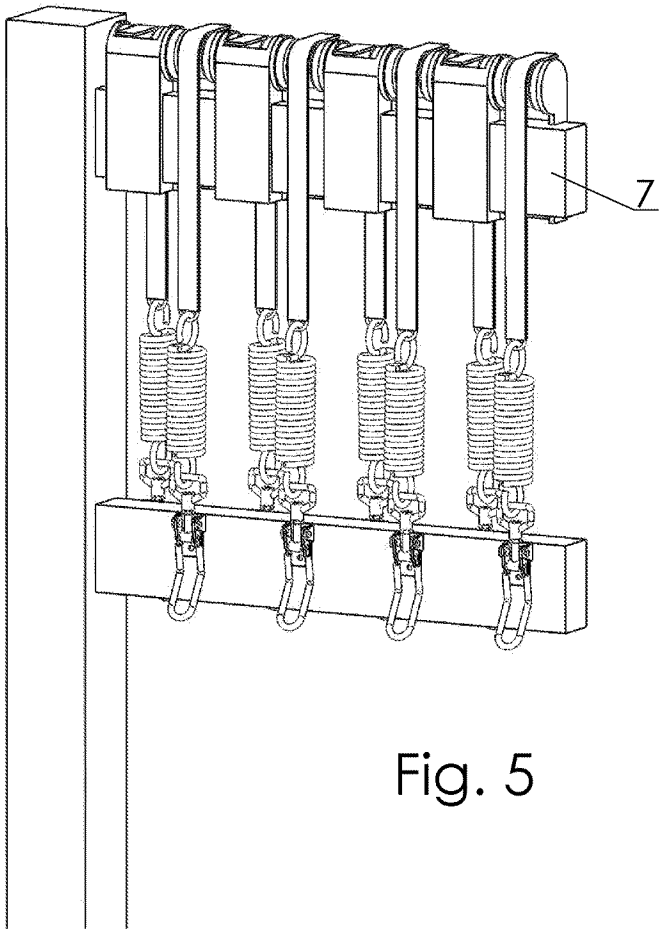
FIG. 5 illustrates how the invention can be alternated to support adjacent trampoline beds on a single upper trampoline frame.

FIG. 5 illustrates the invention alternated along upper trampoline frame 7 to support adjacent trampoline beds to either side of the upper trampoline frame 7. This attachment method is advantageous because utilizing one upper trampoline frame 7 rather than two reduces the surface area between trampoline beds, increasing safety and effectiveness. By alternating the orientation of the invention along upper trampoline frame 7, every other assembly of the invention supports a trampoline bed on one side while the reciprocal assemblies support the other.

Figure 6:
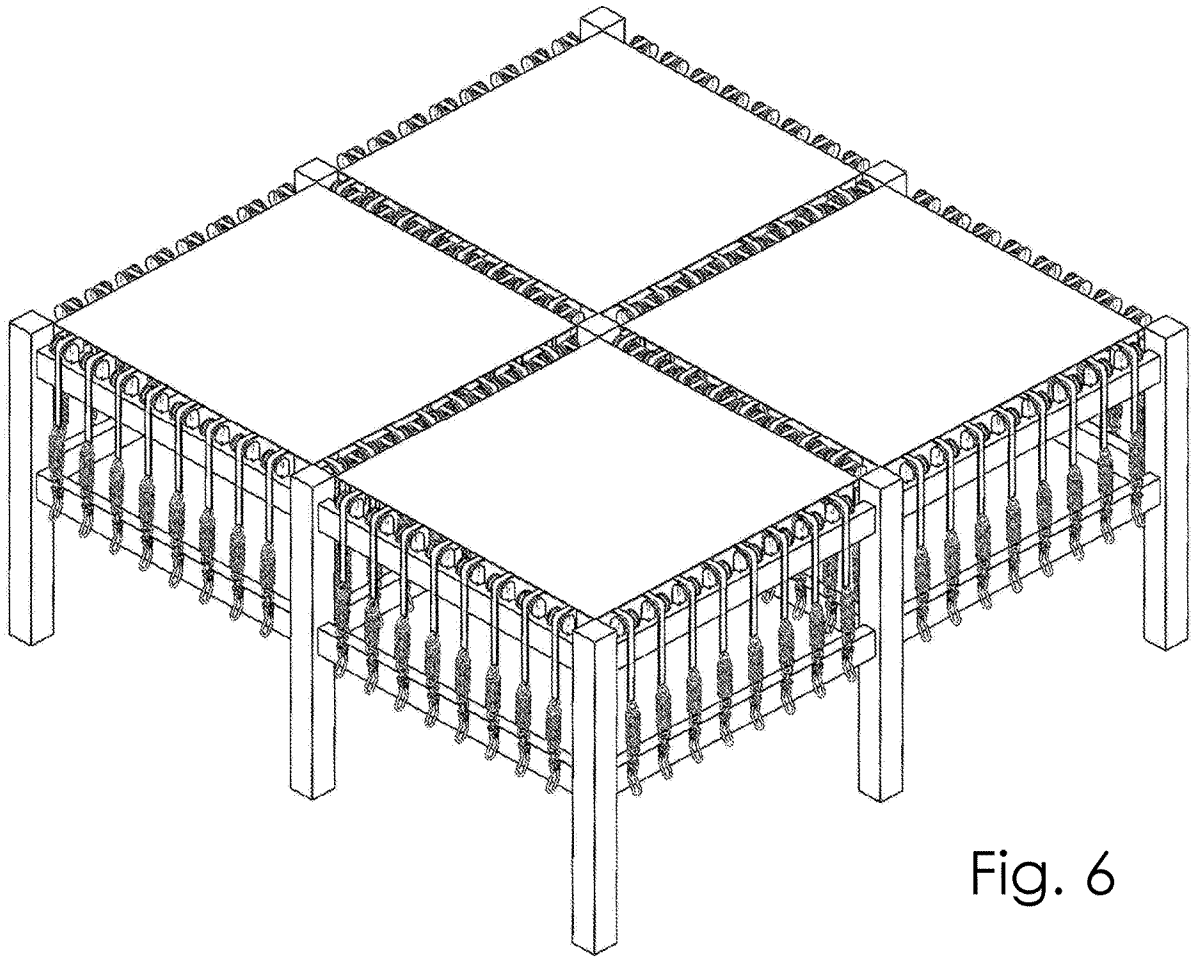
FIG. 6 illustrates the invention in an operational trampoline park setup. Although only four trampoline beds are illustrated, an owner may integrate as many as they prefer.
Figure 7:
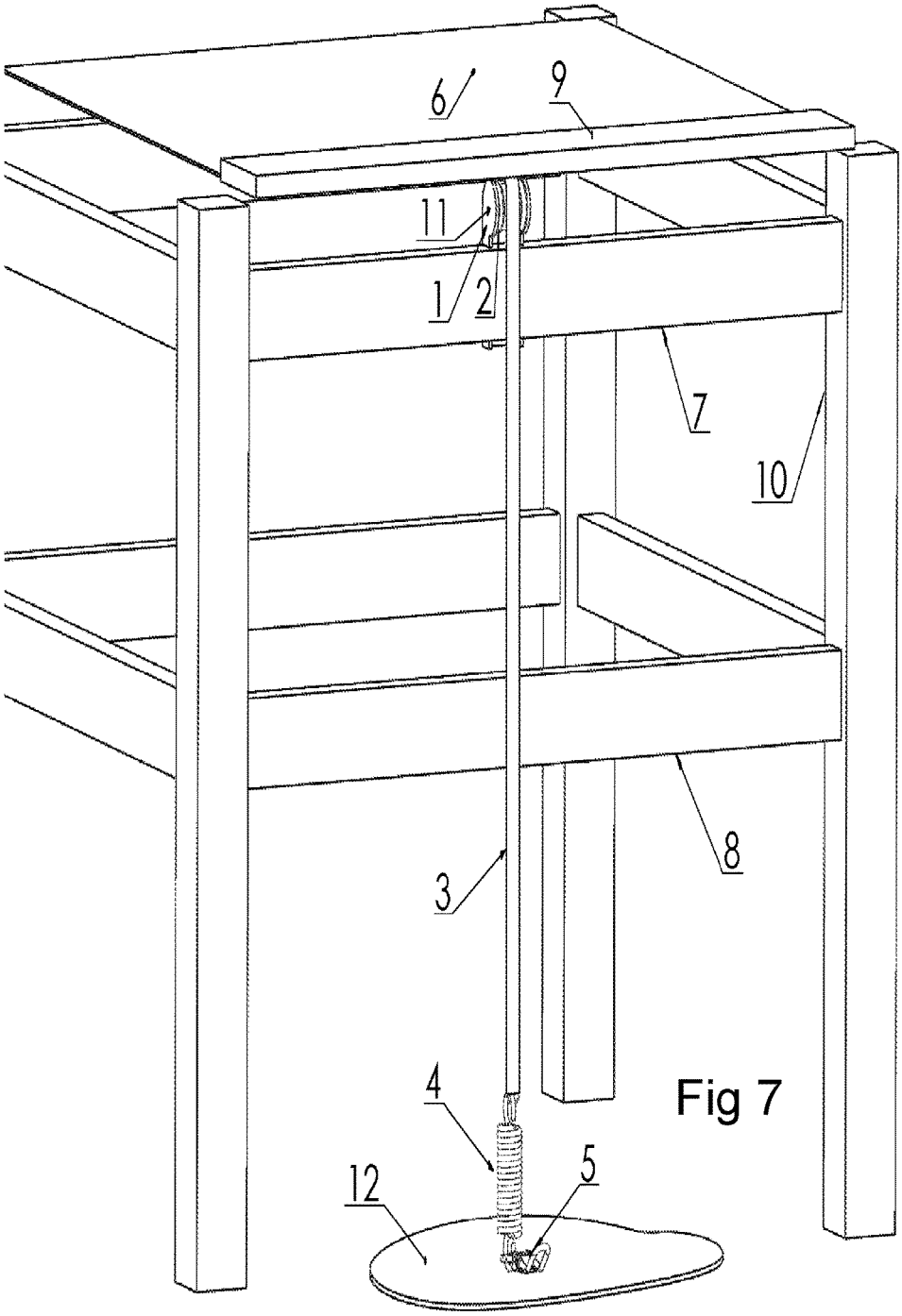
FIG. 7 illustrates an example of the invention in a single trampoline bed setup wherein the resilient means is fastened to the floor.

FIG. 6 illustrates a fully assembled trampoline park. The interior upper trampoline frames alternate the invention to support trampoline beds on adjacent sides as illustrated in FIG. 5 while the exterior upper trampoline frames only support trampoline beds on one side. While only four trampoline beds are shown, an unlimited amount of trampoline beds can be added in the same manner as shown.

What is claimed is:

1. A trampoline bed support system comprising at least one trampoline bed and at least one support device, wherein each support device comprises:

a strap, a pulley, a resilient means, and a tensioner configured to couple to the resilient means to increase or decrease a tension associated with the resilient means, wherein a first portion of the strap is attached to a trampoline bed and a second portion of the strap contacts the pulley in order to redirect a third portion of the strap, and wherein the third portion of the strap is attached to the resilient means.

2. The system of claim 1, wherein the each support device is configured such that the first portion of the strap and the trampoline bed are positioned in a horizontal orientation while the third portion of the strap and the resilient means are positioned in a vertical orientation via redirection of the strap by the pulley.

3. The system of claim 2, further comprising:

a first set of support devices attached to a first trampoline bed, wherein the first set of support devices includes at least two support devices, and wherein each support device within the first set is aligned along a same rotational axis in series.

4. The system of claim 3, further comprising:

a second set of support devices attached to a second trampoline bed, wherein the second set of support devices includes at least two support devices, and wherein each support device within the second set is aligned along the same rotational axis as each of the device within the first set.

5. The system of claim 4, wherein the first set and the second set are configured to alternate in physical placement along the same rotational axis such that no two consecutive support devices attach to a same trampoline bed.

6. The system of claim 5, wherein the second trampoline bed is positioned opposite the first trampoline bed with respect to the same rotational axis.

7. The system of claim 2, wherein the tensioner comprises a lever.

8. A trampoline bed attachment system comprising:

a first trampoline bed, a resilient means, a pulley, an upper support member, a lower support member, and a strap, wherein:

the pulley is mounted to the upper support member, wherein the upper support member is positioned above the lower support member;

a first portion of the strap is connected horizontally to the first trampoline bed;

a second portion of the strap makes contact with the pulley in order to redirect a third portion of the strap vertically and connect to the resilient means; and the resilient means is connected to the lower support member via a tensioner which increases or decreases a tension associated with the resilient means.

9. The trampoline bed attachment system of claim 8, wherein a first plurality of resilient means, pulleys, and straps are mounted to the upper support member such that a rotational axis of the pulleys of the first plurality are aligned in series, and wherein the straps of the first plurality are attached to the first trampoline bed.

10. The trampoline bed attachment system of claim 9, wherein a second plurality of resilient means, pulleys, and straps are mounted to the upper support member such that the rotational axis of the pulleys of the first plurality are aligned in series with a rotational axis of the pulleys of the second plurality, and wherein the straps of the second plurality are attached to a second trampoline bed.

11. The trampoline bed attachment system of claim 10, wherein the straps of the first plurality alternates in position with the straps of the second plurality along the rotational axis of the first and second plurality of pulleys such that no two consecutive straps are attached to a same trampoline bed.

12. The trampoline bed attachment system of claim 11, wherein the first trampoline bed is positioned opposite the second trampoline bed with respect to the rotational axis.

13. A trampoline bed attachment system comprising:

a trampoline bed, a resilient means, a pulley, a pulley pin, a pulley housing, an upper trampoline frame, a secure attachment point, a tensioner, and a nylon strap;

the pulley housing fixed to the upper trampoline frame;

the pulley configured to spin freely within the pulley housing via the pulley pin;

the nylon strap wrapped halfway around the pulley in such a way to redirect the nylon strap 90 degrees;

the nylon strap connecting horizontally to the trampoline bed on one side of the pulley and vertically to the resilient means on another side of the pulley; and the tensioner connecting the resilient means to a member selected from the group consisting of a lower trampoline frame member, an anchor in a floor, and an extended pulley housing.

14. The trampoline bed attachment system of claim 13, wherein the pulley housing is configured to be mounted on a side of the upper trampoline frame to support the trampoline bed on an opposite side of the upper trampoline frame, and wherein the pulley is positioned directly above the upper trampoline frame.

15. The trampoline bed attachment system of claim 14, wherein two or more pulley housings are alternated along the upper trampoline frame to attach to alternating trampoline beds on either side of the upper trampoline frame.

* * * * *